US007607745B2

(12) United States Patent
Ben-Zur

(10) Patent No.: US 7,607,745 B2
(45) Date of Patent: Oct. 27, 2009

(54) DIGITAL PRINTING MACHINE

(75) Inventor: Ofer Ben-Zur, Raanana (IL)

(73) Assignee: Kornit Digital Ltd., Rosh HaAyin (IL)

( * ) Notice: Subject to any disclaimer, the term of this patent is extended or adjusted under 35 U.S.C. 154(b) by 106 days.

(21) Appl. No.: 10/776,163

(22) Filed: Feb. 12, 2004

(65) Prior Publication Data

US 2005/0179708 A1 Aug. 18, 2005

(51) Int. Cl.
*B41J 2/01* (2006.01)

(52) U.S. Cl. ..... 347/2; 347/102; 347/104

(58) Field of Classification Search ..... 347/101, 347/102, 104, 37, 2–4
See application file for complete search history.

(56) References Cited

U.S. PATENT DOCUMENTS

| | | | | |
|---|---|---|---|---|
| 3,968,498 | A | 7/1976 | Uchiyama | 346/29 |
| 4,021,591 | A | 5/1977 | DeVries et al. | 428/200 |
| 4,296,421 | A | 10/1981 | Hara et al. | |
| 4,312,007 | A | 1/1982 | Winfield | |
| 4,380,770 | A | 4/1983 | Maruyama | |
| 4,630,076 | A | 12/1986 | Yoshimura | |
| 4,702,742 | A | 10/1987 | Iwata et al. | 8/495 |
| 5,349,021 | A | 9/1994 | Rooney et al. | |
| 5,501,902 | A | 3/1996 | Kronzer | 428/323 |
| 5,510,415 | A | 4/1996 | Zahrobsky et al. | 524/506 |
| 5,534,904 | A | 7/1996 | Sheinman | 347/75 |
| 5,582,104 | A | 12/1996 | Best et al. | |
| 5,594,044 | A | 1/1997 | Yang | |
| 5,631,684 | A | 5/1997 | Takaide et al. | 347/100 |
| 5,645,888 | A | 7/1997 | Titterington et al. | |
| 5,757,407 | A * | 5/1998 | Rezanka | 347/102 |
| 5,798,179 | A | 8/1998 | Kronzer | 428/411.1 |

(Continued)

FOREIGN PATENT DOCUMENTS

| | | |
|---|---|---|
| GB | 422488 | 1/1935 |

(Continued)

OTHER PUBLICATIONS

International Preliminary Report on Patentability Dated Dec. 14, 2006 From the International Bureau of WIPO Re.: Application No. PCT/il/2005/000558.

(Continued)

*Primary Examiner*—Lam S Nguyen

(57) ABSTRACT

A digital printing machine including a rigid frame, a first linear motion X axis stage mounted on the frame, a printing table assembly movable on each linear X axis stage, a linear motion Y axis stage mounted on the frame perpendicular to the linear X axis stages, above the printing table assemblies, and an array of inkjet nozzles mounted on the linear Y axis stage for linear motion perpendicular to the X axis stage. The printing machine may include a second linear motion X axis stage mounted on the frame parallel to the first axis stage and arranged for operation independently of the first axis stage, and/or a curing unit located above the printing table assembly and arranged to cure ink on media on the printing table assembly and/or an ironing unit located above the printing table assembly and arranged to iron media on the printing assembly before printing thereon, or a first printing table assembly movable on the base of the linear X axis stage and a second printing table assembly movable on the linear X axis stage base independently of the first printing table assembly.

32 Claims, 10 Drawing Sheets

U.S. PATENT DOCUMENTS

| | | | | |
|---|---|---|---|---|
| 5,981,113 | A | 11/1999 | Christian | |
| 5,988,791 | A | 11/1999 | Miyashita et al. | 347/43 |
| 6,042,228 | A * | 3/2000 | Yamada et al. | 347/104 |
| 6,087,061 | A | 7/2000 | Hare et al. | 430/256 |
| 6,095,628 | A | 8/2000 | Rhome | 347/4 |
| 6,117,921 | A | 9/2000 | Ma et al. | |
| 6,126,281 | A | 10/2000 | Shimoda et al. | |
| 6,140,391 | A | 10/2000 | Zou et al. | |
| 6,156,072 | A | 12/2000 | Usui et al. | 8/115.6 |
| 6,161,929 | A | 12/2000 | Erdtmann et al. | 347/101 |
| 6,183,079 | B1 | 2/2001 | Meade et al. | 347/101 |
| 6,196,674 | B1 | 3/2001 | Takemoto | |
| 6,206,516 | B1 | 3/2001 | Moriyama et al. | 347/101 |
| 6,262,796 | B1 * | 7/2001 | Loopstra et al. | 355/53 |
| 6,267,518 | B1 | 7/2001 | Abe | 400/188 |
| 6,270,189 | B1 | 8/2001 | Miyashita et al. | 347/43 |
| 6,291,023 | B1 | 9/2001 | Nigam | |
| 6,300,391 | B2 | 10/2001 | Parazak et al. | |
| 6,322,620 | B1 | 11/2001 | Xiao | |
| 6,326,419 | B1 | 12/2001 | Smith | |
| 6,335,140 | B1 | 1/2002 | Miyazaki | 430/138 |
| 6,341,856 | B1 | 1/2002 | Thompson et al. | |
| 6,416,923 | B2 | 7/2002 | Miyazaki | 430/200 |
| 6,450,633 | B1 | 9/2002 | Kronzer | 347/105 |
| 6,464,649 | B1 | 10/2002 | Duchon et al. | 600/583 |
| 6,500,880 | B1 | 12/2002 | Parazak | |
| 6,513,924 | B1 | 2/2003 | Goldberg et al. | |
| 6,536,894 | B1 * | 3/2003 | Rasmussen et al. | 347/104 |
| 6,606,427 | B1 | 8/2003 | Graves et al. | |
| 6,626,530 | B2 | 9/2003 | Snow et al. | |
| 6,647,208 | B1 | 11/2003 | Kirby | |
| 6,698,874 | B2 | 3/2004 | Katsuki | |
| 6,755,518 | B2 * | 6/2004 | Codos | 347/102 |
| 6,840,992 | B2 | 1/2005 | Glaum et al. | |
| 6,879,378 | B2 * | 4/2005 | Morita et al. | 355/53 |
| 7,134,749 | B2 | 11/2006 | Ben Zur et al. | |
| 2002/0009662 | A1 | 1/2002 | Miyazaki | 430/138 |
| 2002/0022120 | A1 | 2/2002 | Katsuki et al. | 428/195 |
| 2002/0060728 | A1 | 5/2002 | Koizumi et al. | |
| 2003/0142167 | A1 * | 7/2003 | Nakamura et al. | 347/37 |
| 2003/0157304 | A1 | 8/2003 | Li et al. | |
| 2003/0197772 | A1 * | 10/2003 | Iwatsuki et al. | 347/104 |
| 2003/0205159 | A1 | 11/2003 | McNeil | |
| 2005/0179706 | A1 | 8/2005 | Childers | |
| 2007/0103529 | A1 | 5/2007 | Pearl et al. | |
| 2007/0104899 | A1 | 5/2007 | Pearl et al. | |
| 2008/0012884 | A1 | 1/2008 | Ben-Zur et al. | |

FOREIGN PATENT DOCUMENTS

| | | |
|---|---|---|
| JP | 11138768 | 5/1999 |
| WO | 9830749 | 7/1998 |
| WO | 9956948 | 11/1999 |
| WO | 0073570 | 12/2000 |
| WO | 0117792 | 3/2001 |
| WO | 0132974 | 5/2001 |
| WO | 02066565 | 8/2002 |

OTHER PUBLICATIONS

International Preliminary Report on Patentability Dated Jul. 17, 2007 From the International Preliminary Examining Authoirty Re.: Application No. PCT/IL05/00166.

International Preliminary Report on Patentability Dated Nov. 26, 2007 From the International Preliminary Examining Authority Re.: Application No. PCT/IL05/00559.

International Preliminary Report on Patentabillity Dated Feb. 8, 2007 From the International Preliminary Examining Authority Re.: Application No. PCT/IL05/00166.

Office Action Dated Feb. 21, 2006 From the Israeli Patent Office Re.: Application No. 162231 and Its Translation Into English.

Office Action Dated Jul. 3, 2006 From the Israeli Patent Office Re.: Application No. 162231 and Its Translation Into English.

Official Action Dated May 7, 2009 From the US Patent and Trademark Office Re.: U.S. Appl. No. 11/588,277.

Official Action Dated Mar. 10, 2006 From the US Patent and Trademark Office Re.: U.S. Appl. No. 10/461,414.

Official Action Dated Jul. 17, 2008 From the US Patent and Trademark Office Re.: U.S. Appl. No. 11/606,154.

Official Action Dated Jul. 17, 2008 From US Patent and Trademark Office Re.: U.S. Appl. No. 11/606,154.

Official Action Dated Mar. 31, 2009 From the US Patent and Trademark Office Re.: U.S. Appl. No. 11/606,154.

Official Action Dated May 14, 2009 From the US Patent and Trademark Office Re.: U.S. Appl. No. 11/606,242.

* cited by examiner

DIGITAL PRINTING MACHINE

FIELD OF THE INVENTION

The present invention relates to apparatus for digital printing in general and, in particular, to a high-speed digital garment printing machine.

BACKGROUND OF THE INVENTION

Garment printing is performed today by screen printing press machines that are complex, inflexible, and require a specific set-up for each different print and color. First, an image file undergoes a mechanical spot-color separation process (each color is printed in black and white on a separate sheet of paper or film). Then, the image is "developed" in a long optical process, into a fine mesh (screen), which is pressed during the printing process against the media. Before printing, each screen has to be set in the proper station and adjusted with reference to the other screens. Ink is transferred to the garment through the mesh by mechanical means (generally wiping a squeegee along the screen). Garment screen-printing technology requires a special press station for each color level. Print quality is limited due to the high registration requirements between stations; hence printing resolution is relatively low.

Garment presses are usually carousel machines based on up to 24 press stations. These machines occupy large floor area and are complex to service and maintain. Thus, conventional screen-printing technology is not cost effective for short run processes, especially for sample printing stages, although it is cost effective and fast for long run tasks.

An attempt has been made to provide a device for printing onto a portion of a substrate, such as a garment. U.S. Pat. No. 6,095,628 describes and claims an apparatus for ink jet printing pre-programmed viewable indicia onto a substrate. The apparatus is essentially a conventional ink jet printer, and is capable of creating the indicia through ink jet ink depositing upon flat or rigid substrates as a result of controlled platen movement beneath the ink jet printer head and controlled ink jet printer head movement and ink flow control by a programmed CPU. The flexible printing substrate of the patented invention is larger than the platen and portions of the substrate are draped downwardly over edges of the platen and tucked under the platen.

Accordingly, there is a strong felt need for an efficient, fast, automated, digital garment printing machine which could provide high resolution, multicolor prints in a short lead-time.

SUMMARY OF THE INVENTION

The present invention provides a digital printing machine permitting accurate, high resolution printing on a substrate with relatively high efficiency, for decoration of garments and other rigid or flexible substrates.

There is thus provided, in accordance with the present invention, a digital printing machine including a rigid frame, a first linear motion X axis stage mounted on the frame, a second linear motion X axis stage mounted on the frame parallel to the first axis stage, and arranged for operation independently of the first axis stage, a printing table assembly movable on each linear X axis stage, a linear motion Y axis stage mounted on the frame perpendicular to the linear X axis stages, above the printing table assemblies, and an array of inkjet nozzles mounted on the linear Y axis stage for linear motion perpendicular to the X axis stage.

According to one embodiment of the invention, each printing table assembly includes a media-holding plate and an openable cover pivotally coupled to the media-holding plate for holding the media firmly against the plate.

Further according to the invention, the printing machine further includes a curing unit located above each printing table assembly and arranged to cure ink on media on the printing table assembly.

Still further according to the invention, the printing machine further includes an ironing unit located above each printing table assembly and arranged to iron media on the printing table assembly before printing thereon.

There is also provided, according to the present invention, a printing machine including a rigid frame, a linear motion X axis stage mounted on the frame, a printing table assembly movable on the linear X axis stage, a linear motion Y axis stage mounted on the frame perpendicular to the linear X axis stage, above the printing table assembly, an array of inkjet nozzles mounted on the linear Y axis stage for linear motion perpendicular to the X axis stage, a curing unit located above the printing table assembly and arranged to cure ink on media on the printing assembly, and an ironing unit located above the printing table assembly and arranged to iron media on the printing assembly before printing thereon.

According to one embodiment, the curing unit is an infrared system. According to an alternative embodiment, the curing unit is a hot air blowing unit.

There is also provided according to the present invention a printing machine including a rigid frame, a linear motion X axis stage base mounted on the frame, a first printing table assembly movable on the linear X axis stage base, a second printing table assembly movable on the linear X axis stage base independently of the first printing table assembly, a linear motion Y axis stage mounted on the frame perpendicular to the linear X axis stages, above the printing table assemblies, and an array of inkjet nozzles mounted on the linear Y axis stage for linear motion perpendicular to the X axis stage.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a digital printing machine for various substrates which permits accurate, high quality, high resolution, multi-color printing directly onto a substrate in a relatively simple machine. This is accomplished by incorporating an array of inkjet nozzles, such as drop-on-demand or continuous inkjet nozzles, automatic handling units and a curing system in a high speed computerized unit for the garment industry, in general, and for T-shirt printing, in particular. The machine further includes an accurate X,Y,Z motion system and a printing table. Since the printing machine is particularly suited to printing on a garment, it has been described herein with respect to garment printing, by way of example only. However, it will be appreciated that any other suitable substrate can alternatively be utilized.

A digital printing machine has the following advantages over conventional screen-printing devices:

- The image file is received in conventional format without the need for spot color separation process.
- No screen "development" process is needed.
- The transition from one job to another does not require replacement of screens, cleaning, etc.
- Printing flexibility: the image can be modified for each print. Variable data is printed at the same speed.
- The image can be printed in a variety of color levels.
- The machine occupies a smaller floor area.
- Higher printing resolution can be achieved.
- Printing files are stored efficiently in a way that eliminates the need for large screen storage area and screen cleaning processes.
- Printing directly onto a garment or textile obviates the need for transfer paper and an additional transfer step.

Figure 1:
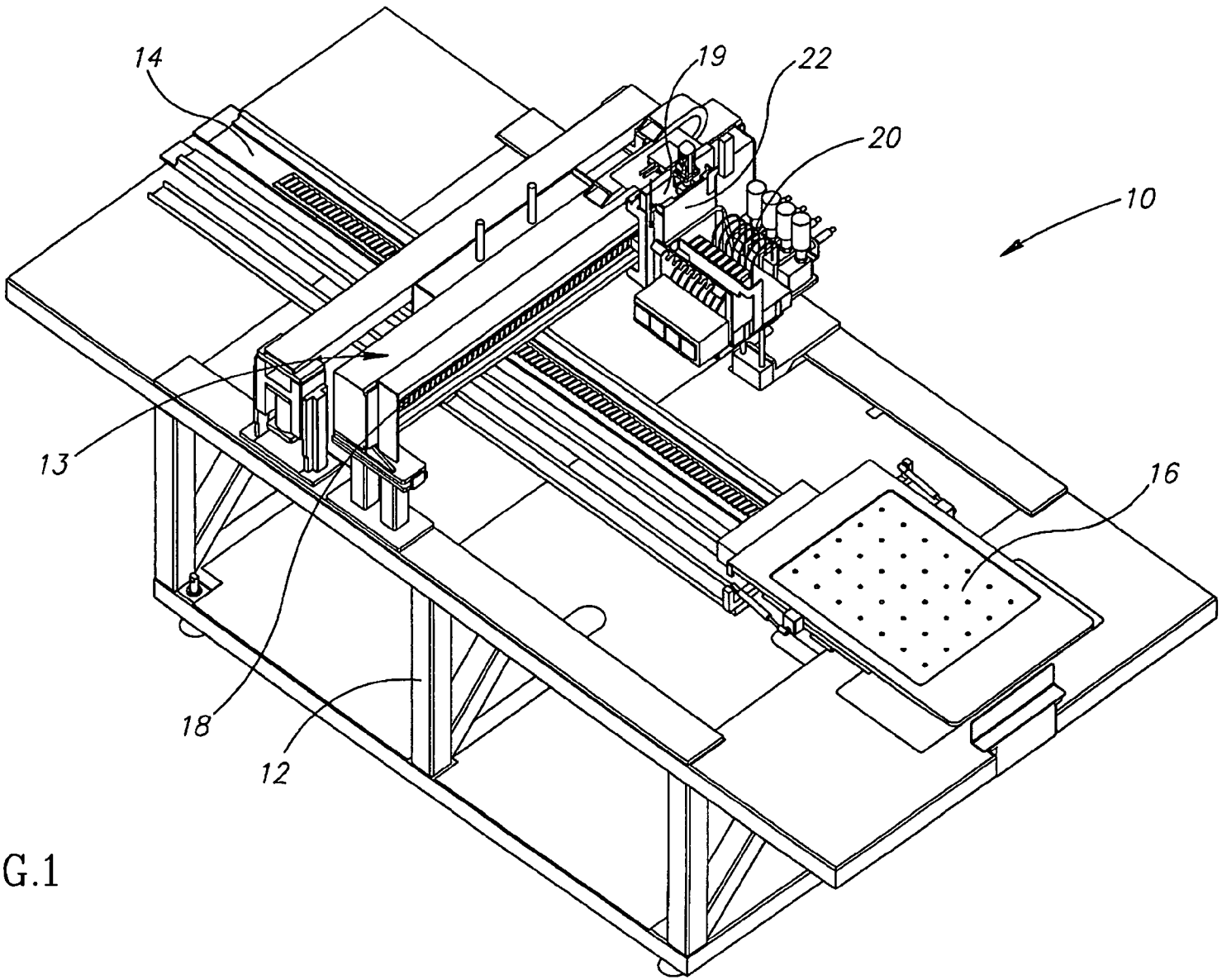
FIG. 1 is a perspective drawing of a garment printing machine constructed and operative in accordance with one embodiment of the present invention.

Referring now to FIG. 1, there is shown a schematic perspective drawing of a digital garment printing machine 10 constructed and operative in accordance with one embodiment of the present invention. Garment printing machine 10 is based on a rigid frame 12 in which an accurate linear motion X axis stage 14 is installed. According to one embodiment, X-axis stage 14 is a linear motor driven stage, and can be a conventional linear stage. Alternatively, X-axis stage 14 can be any other type of linear stage, like a belt-driven stage, or ball screw driven stage. A printing table assembly 16 is connected to X axis stage 14, which preferably provides high acceleration and scanning speed.

Perpendicular to the X axis direction, an accurate linear motion Y axis stage 18 is installed above printing table assembly 16, preferably on a bridge 13. Stages X and Y can be known-in-the-art linear stages, including linear rails, like rails marketed by THK Co., Ltd., Tokyo, Japan, a linear encoder like that sold by RSF Elektronik Ges.m.b.H., Tarsdorf, Austria, and a moving plate supported on the rails. According to a preferred embodiment of the invention, the X axis stage 14 is a linear motor driven stage, capable of high acceleration rate and stiffness, for example, Anorad brand model LW10 of Rockwell Automation, Shirley, N.Y., USA. Closed loop control is responsible for the high accuracy and motion smoothness. The position of the printing table 16 along the rails of X axis stage 14 is measured by a linear encoder, and is used also to determine the firing timing of the inkjet nozzles. Y axis stage 18 is preferably a linear motor stage similar to X axis stage 14.

A printing heads array 20, including a plurality of inkjet nozzles, is connected to a vertical Z-axis system 22, which is preferably a ball screw driven stage. Z axis stage 22 is supported on Y-axis moving plate 19, to allow motion perpendicular to the direction of movement of printing table 16. The gap between heads array 20 and media on printing table assembly 16 is an important parameter for high quality printing. Z stage 22 enables movement of printing heads array 20 in the vertical direction for calibration for different media heights. It will be appreciated that, while the machine is particularly suited for printing on a finished garment, other media can alternatively be employed. The present invention will be described with regard to a finished garment, for ease of description by way of example.

Figure 2:
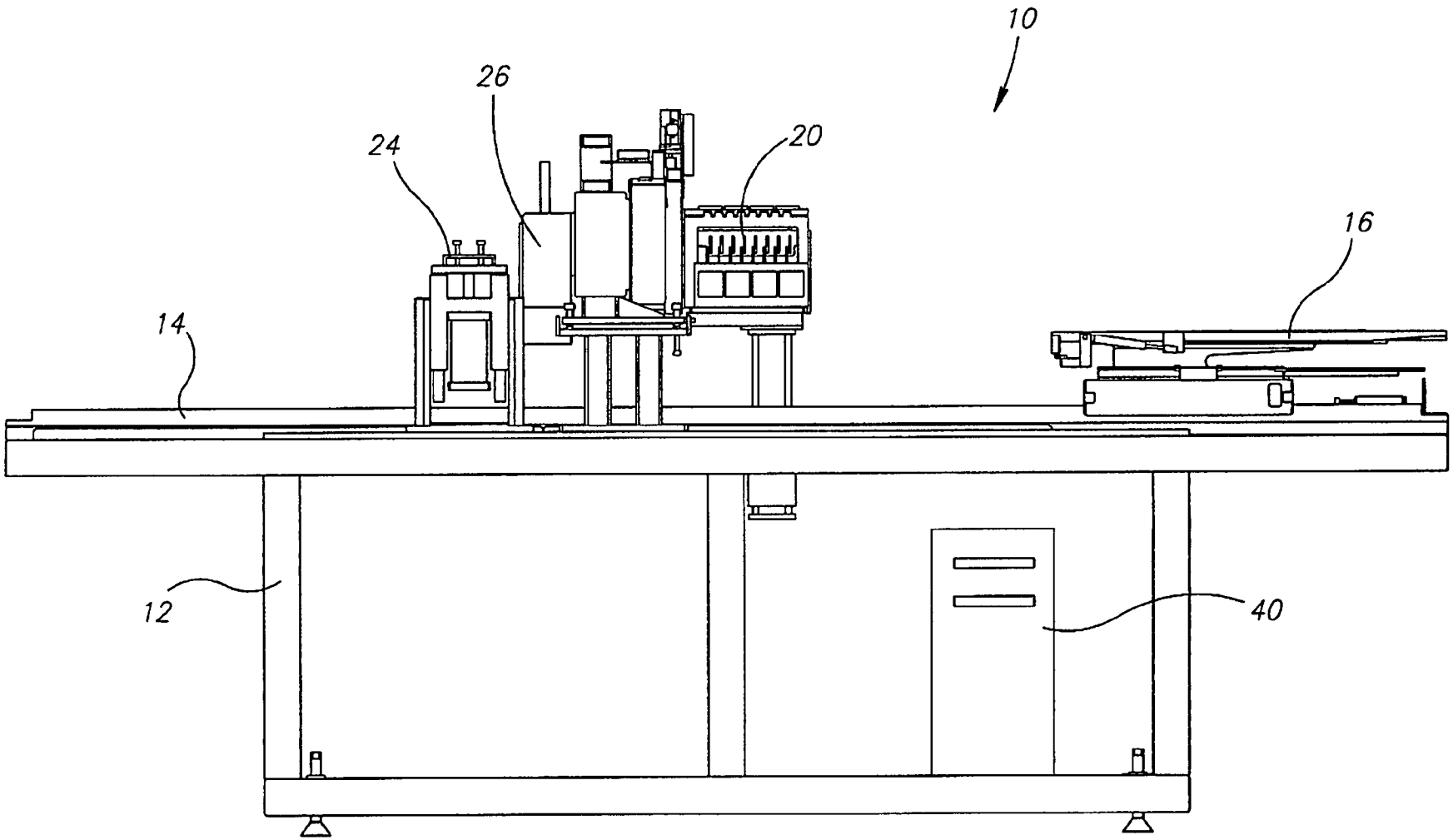
FIG. 2 is a side view of a garment printing machine constructed and operative in accordance with one embodiment of the present invention.

Referring now to FIG. 2, an ironing unit 24 is supported on frame 12 above X axis stage 14, preferably on a bridge, such that printing table assembly 16 can move underneath. The ironing unit 24 prepares the media for printing, as will be further explained in detail below. Another unit supported on frame 12 is the curing unit 26. According to one embodiment, curing unit 26 is an infrared heating unit that evaporates the ink carrier as printing is accomplished or during print passes. According to another embodiment, curing unit 26 can be a hot air blower. Alternatively, any other curing unit can be utilized, which is suited to the type of ink printed on the garment.

A main computer 40, preferably a microprocessor, controls the entire system, and is coupled to each of the various units for coordination, synchronization, and activation, in accordance with a pre-programmed printing process. Main computer 40 coordinates a large number of functions. It receives images from an image file, processes the images to be printed, activates the curing unit, and controls the motion systems, the ironing unit, and more. Preferably, movement of the X and Y axis stages is coordinated by the microprocessor with the nozzles firing command by a print heads controller, so that precise printing of a desired object or symbol can be performed.

Figure 3A:
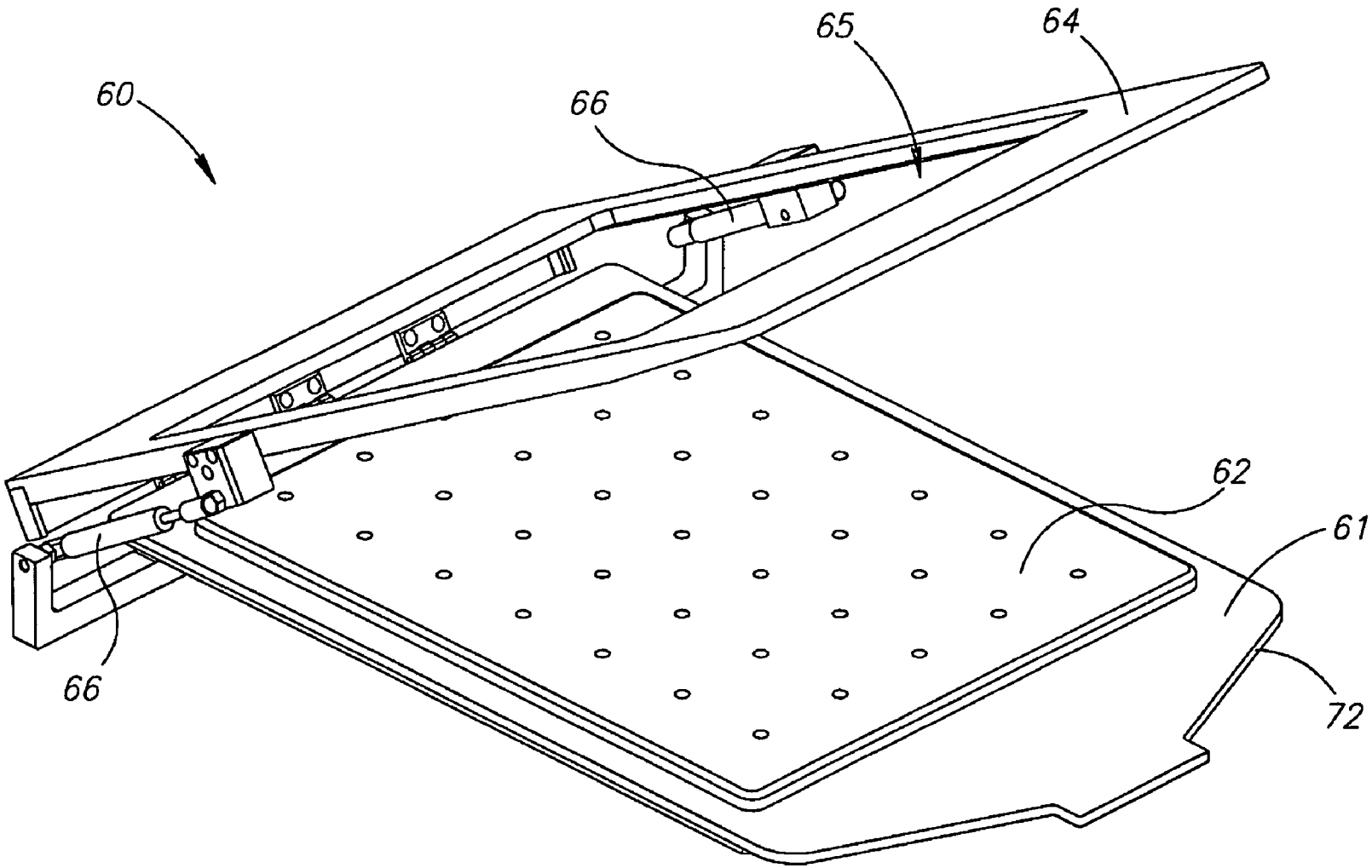
FIG. 3*a*, 3*b*, 3*c* are perspective drawings of a printing table system constructed and operative in accordance with one embodiment of the present invention.
Figure 3B:
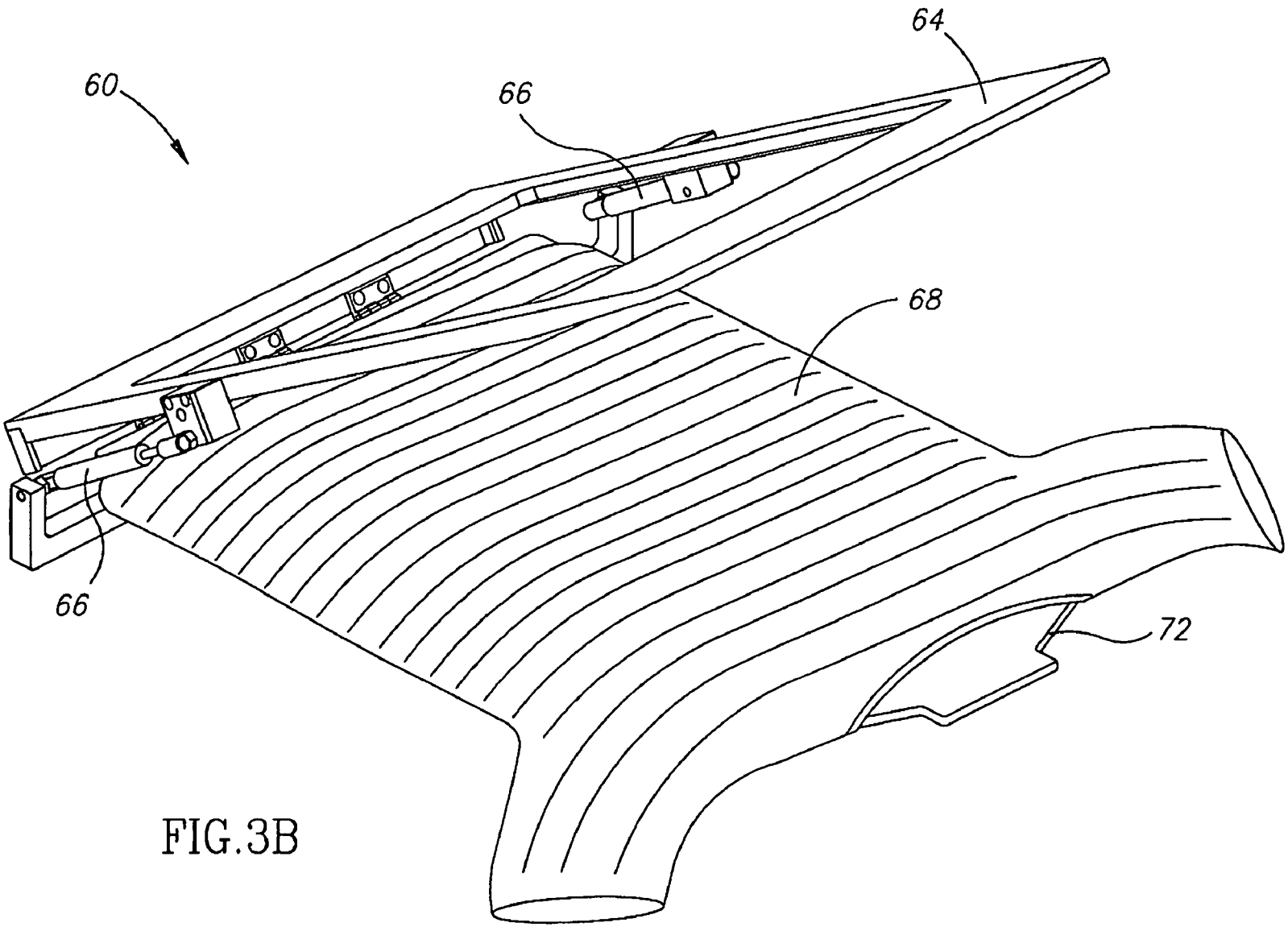
Figure 3C:
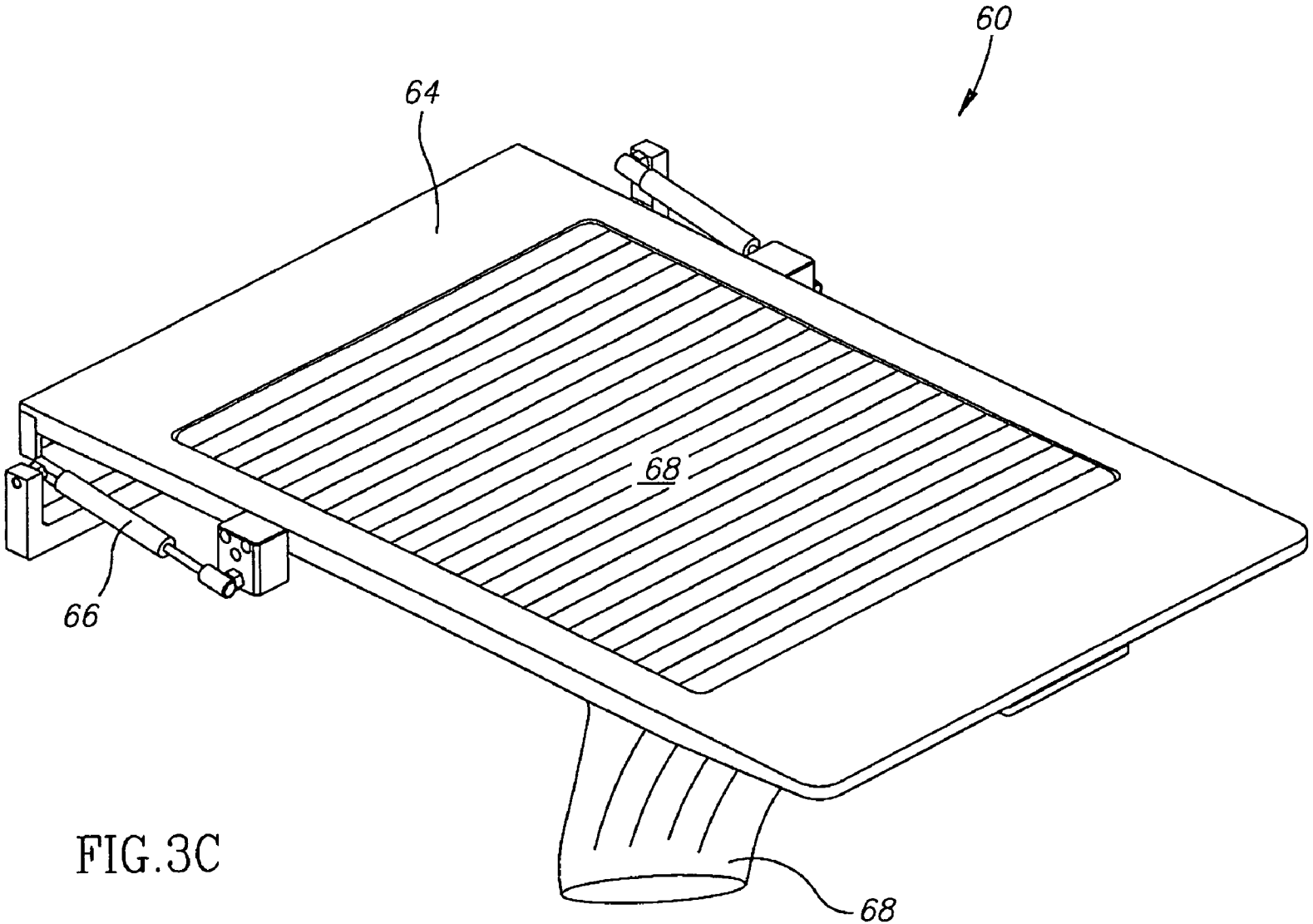

A printing table assembly 60 constructed and operative in accordance with one embodiment of the present invention is shown in FIGS. 3*a*, 3*b* and 3*c*. Printing table assembly 60 includes a media-holding plate 61 and an openable cover 64. Preferably, media-holding plate 61 includes a raised portion 62 of the same size as the image to be printed, and cover 64 includes a window 65 of the same shape as raised portion 62. Preferably, the window 65 is slightly larger in size, preferably a few millimeters, than raised portion 62.

Referring to FIG. 3*a*, cover 64 is held in an open position by two gas cylinders 66, as known in the industry. Preferably, at least part of the printing table assembly, for example the raised portion 62, is a vacuum table, to allow holding of non-porous media such as paper, boards, plastic etc.

FIG. 3*b* shows a garment 68 loaded onto table assembly 60. Garment 68 is loaded manually onto plate 61, as the plate's chamfers 72 center the garment on the plate. As can be seen in FIG. 3*c*, after garment 68 is loaded onto table assembly 60, cover 64 is closed against plate 61, while gas cylinders 66 urge the cover to the closed orientation. The edges of the garment are stretched slightly by the cover surface that touches the table lower surface around the raised portion 62. As a result, the garment is held firmly in place to allow high resolution printing (i.e., there is substantially no movement of the media during printing or wrinkling).

According to another embodiment of this invention, printing table assembly is a simple, flattened plate, made of aluminum or wood on which a textile piece or a garment is positioned. Flattened plates are well known by those who are familiar with the garment printing industry.

Figure 4:
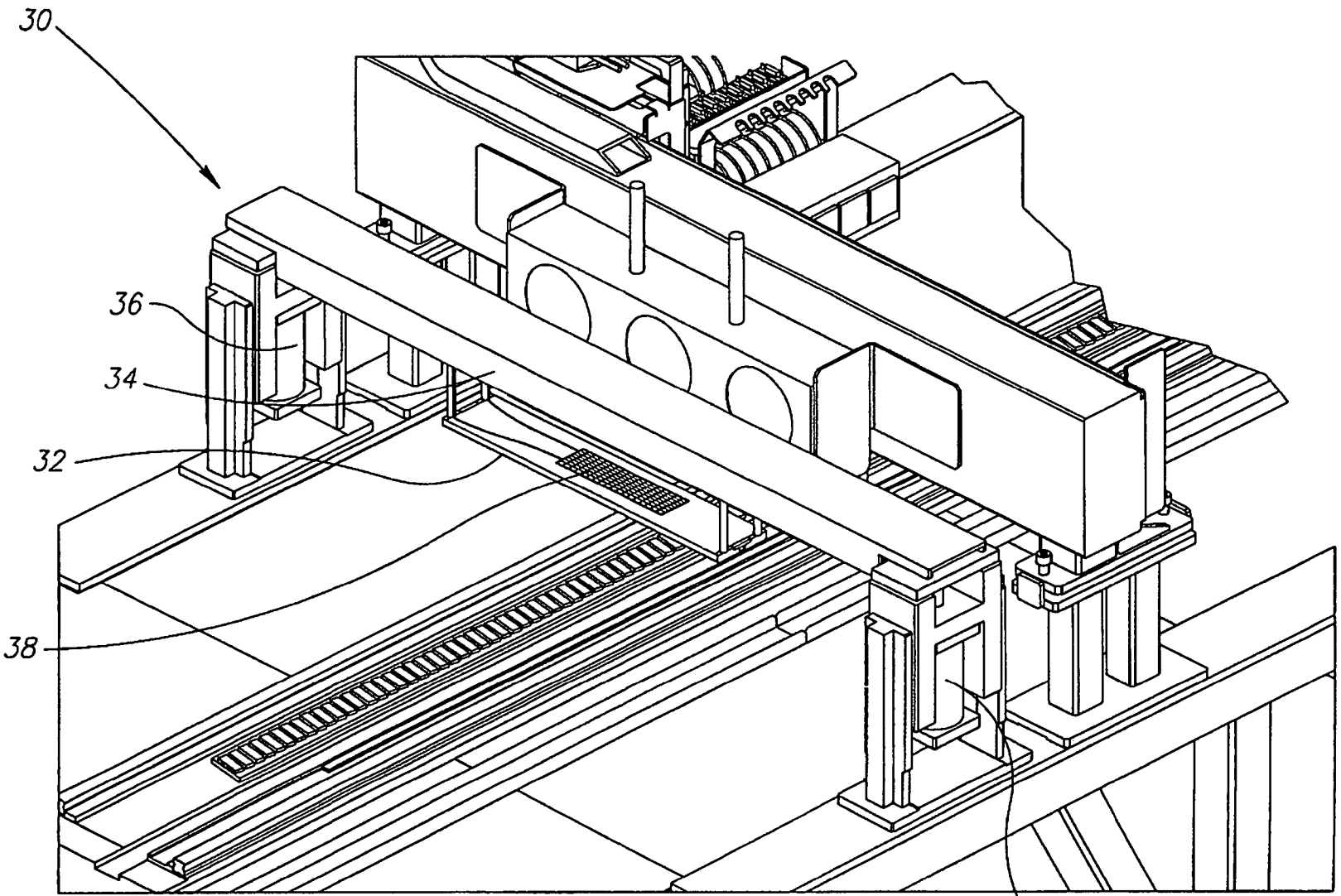
FIG. 4 is a perspective drawing of an ironing unit constructed and operative in accordance with one embodiment of the present invention.

After garment 68 is loaded, the printing table assembly may be moved to a position below the ironing unit. As can be seen in FIG. 4, ironing unit 30 is built from a heatable plate 32 supported on a frame 34 including means for vertical movement of the plate 32. In the illustrated embodiment, frame 34 is carried by two air pistons 36, which are well known in the industry. Heatable plate 32 is preferably a Teflon-coated stainless steel plate, heated, for example, by a strip heater 38, such as that sold by Minco Products, Inc., Minnesota, USA. Air pistons 36 are controlled by controller 40, and move downward, thereby providing contact of the heatable plate with the media on the printing table assembly. Now, printing table assembly 60 is moved, thereby sliding garment 68 beneath heatable plate 32, allowing ironing of garment 68 by the ironing unit. After ironing, garment 68 is flat, dry and ready for the high resolution printing process.

Figure 5:
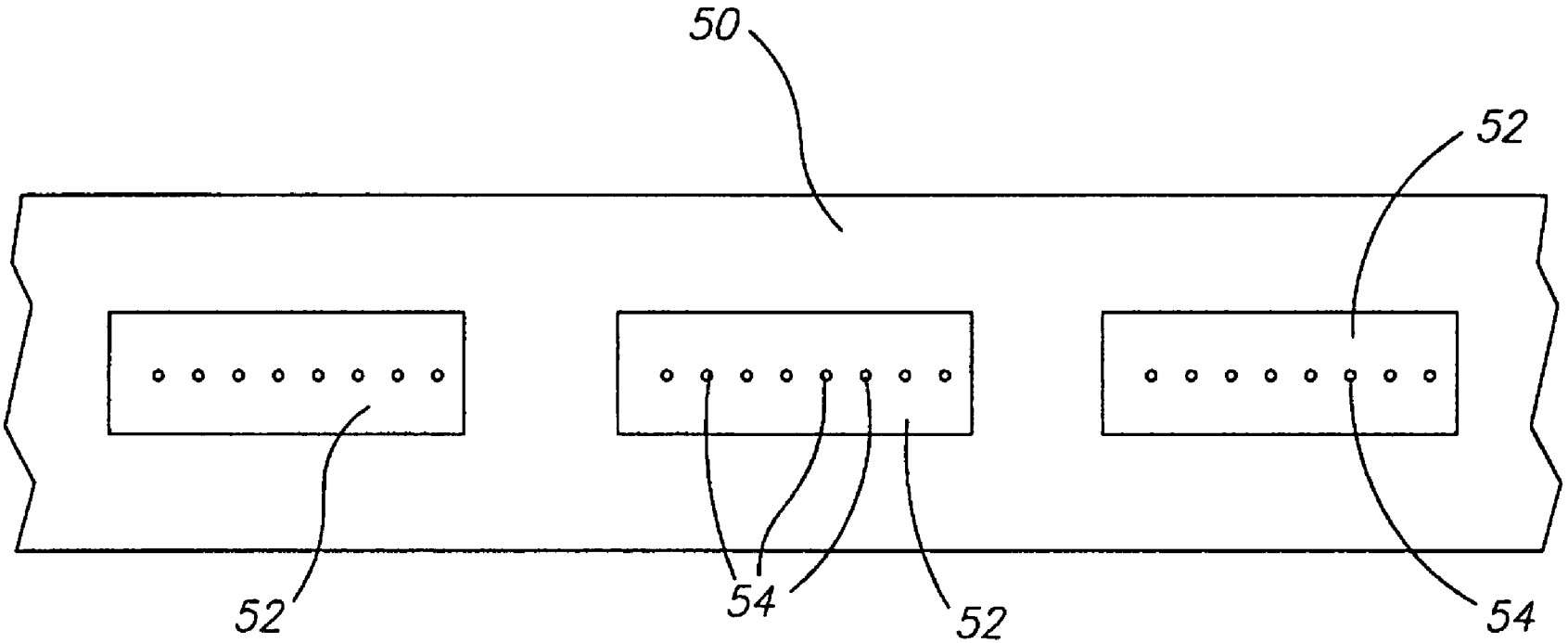
FIG. 5 is a schematic detail illustration of a portion of a printing heads array constructed and operative in accordance with one embodiment of the invention.
Figure 6D:
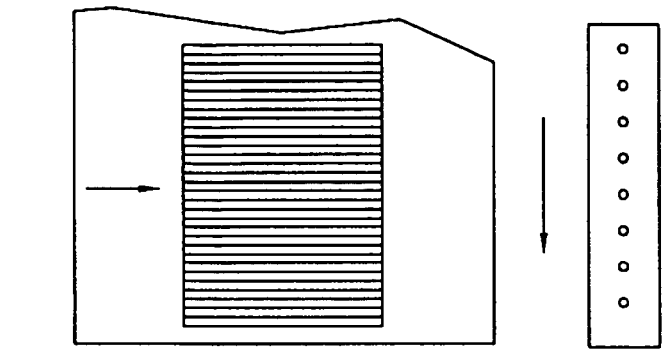
FIGS. 6*a*, 6*b*, 6*c* and 6d are schematic illustrations of operation of the printing heads array of FIG. 5.
Figure 6C:
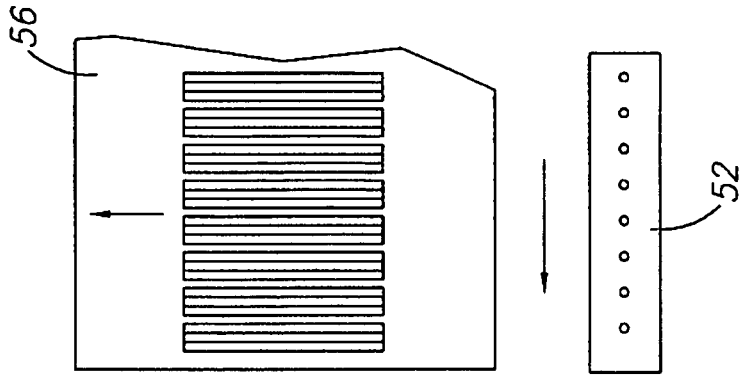
Figure 6B:
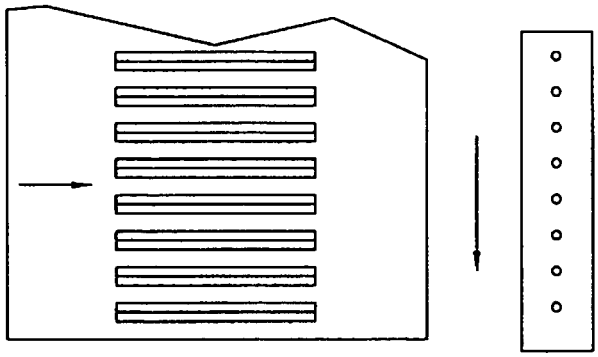
Figure 6A:
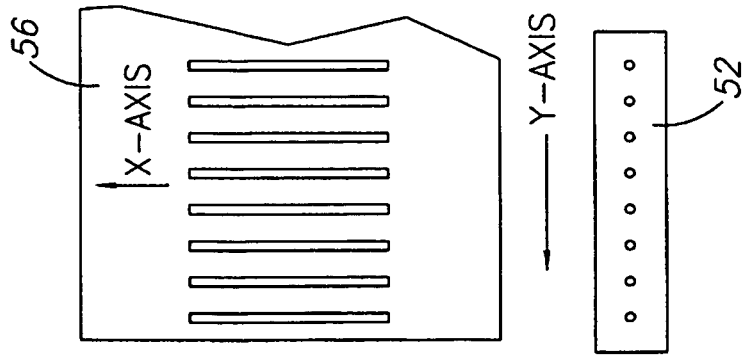

Garment printing machine 10 also includes an array 50 of printing heads 52, shown schematically in FIG. 5, arranged for printing directly on a finished garment, a textile piece or other flexible or rigid medium. Printing heads array 50 includes a plurality of printing heads 52 including inkjet nozzles 54. Printing heads 52 can be any conventional printing heads, such as those marketed by Spectra, Inc., New Hampshire, USA and others known in the industry.

According to one preferred embodiment of the invention, printing heads array 50 is a massive array of conventional piezoelectric drop-on-demand or continuous inkjet heads, which perform the high-speed printing. It is a particular feature of the present invention that at least a 500, and preferably several thousands (i.e., 2,000) nozzles are provided for simultaneous printing, resulting in a very quick and accurate process. Each head 52 consists of dozens of nozzles 54 which are controlled independently by main computer 40.

According to a preferred embodiment, the distances between nozzles and between printing heads are bigger than the printing resolution, hence several print passes are needed to complete the image, as shown schematically in FIGS. 6*a*, 6*b*, 6*c* and 6*d*. FIGS. 6*a* to 6*d* are schematic detail illustrations of a single print head 52 and a portion of the media 56 to be printed. After each pass in the X-axis, here created by movement of the printing table assembly with media 56, the printing head 52 moves incrementally in the Y-axis to prepare for the next pass. It will be appreciated that the computer 40 is programmed to control the relative motion of the printing heads and the printing table assembly so as to obtain this accurate and complete coverage.

The printing process is performed while relative motion occurs between the printing heads array 50 and printing table assembly 60. At least two axes of motion are needed for this multi-color printing: X axis motion that is in the printing direction; and Y axis motion that is perpendicular to the printing direction. As stated above, the distances between nozzles and between printing heads are bigger than the printing resolution, hence several print passes are needed to complete the image. This is accomplished by moving the printing table assembly 60 back and forth along the X axis while moving the heads array 50 perpendicular to the line of printing. The X-axis is the printing line and the Y-axis is the line on which the printing heads array moves after each pass to fill the gaps between printed lines in the next pass. Multi-color printing is performed as the table surface passes below the drop-on-demand inkjet nozzles array.

According to an alternative embodiment of the invention, the Y axis is the fast-moving axis, while the X axis moves incrementally to permit filling in of the gaps between printed lines.

A printing command is sent by the printing heads driver (not shown) to each nozzle at the exact time and location for ink firing. The printing command is actually an electronic pulse, with exact width, voltage level, rise time and decay time. Printing heads drivers are commercial systems known in the industry, such as Inca drivers, of IncaDigital Printers, Cambridge, England. When printing is completed, the printing table is moved to a loading position. Then, the printed garment is unloaded and a new garment is loaded onto the printing table.

The printing machine of the embodiments described above incorporates two processes, one after the other:

1. Loading and un-loading garments.
2. The printing process itself.

In order to increase the throughput of the machine, both these processes can be performed in parallel, as seen in the following embodiments of the invention.

Figure 7A:
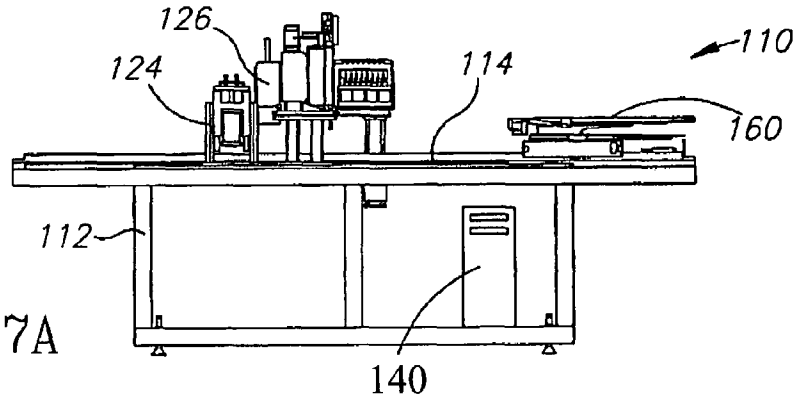
FIGS. 7*a*, 7*b* and 7*c* are respective side, front and top views of a garment printing machine constructed and operative in accordance with second embodiment of the present invention.
Figure 7C:
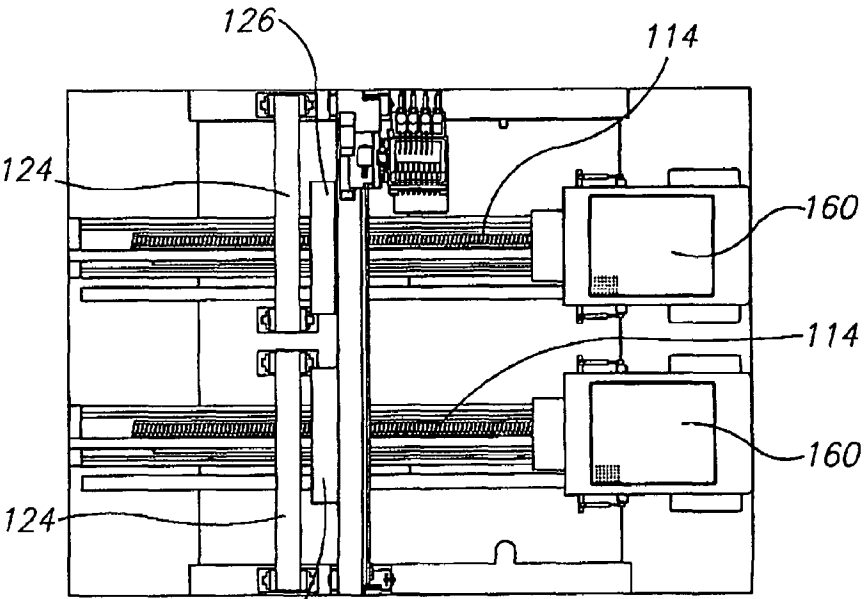
Figure 7B:
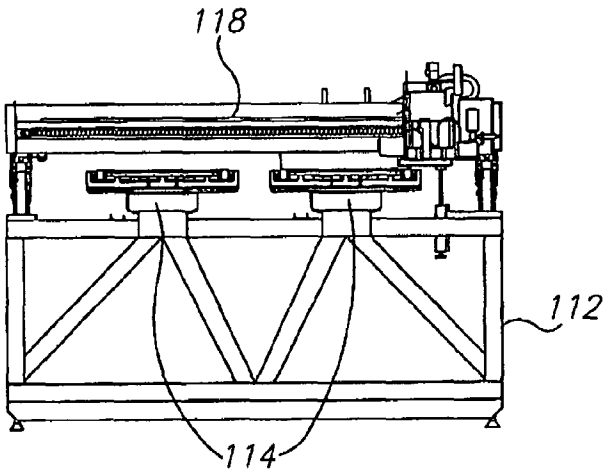

Referring now to FIGS. 7*a*, 7*b* and 7*c*, respective side, front and top views of a second embodiment of the invention 110 are presented. Frame 112 is wider than frame 12 shown in FIG. 1, and two independent X linear axis stages 114 are installed instead of one X axis stage, as in the first embodiment. Y axis stage 118 is substantially the same as Y axis stage 18 in FIG. 1. Machine 110 has also two curing units 126, two ironing units 124 and two printing table assemblies 160. It is a particular feature of the present embodiment that the X axis stages operate independently from one another. Thus, the process of loading and un-loading can be carried out on one printing assembly at the same time that printing is being carried out on the second printing assembly. As a result, the printing heads array is working substantially continuously, dramatically improving throughput of the machine. Each table can be accessed from the same edge of the machine, thereby permitting a single worker to operate two printing assemblies. Main computer 140 controls both X axis stages for independent operation.

Figure 8:
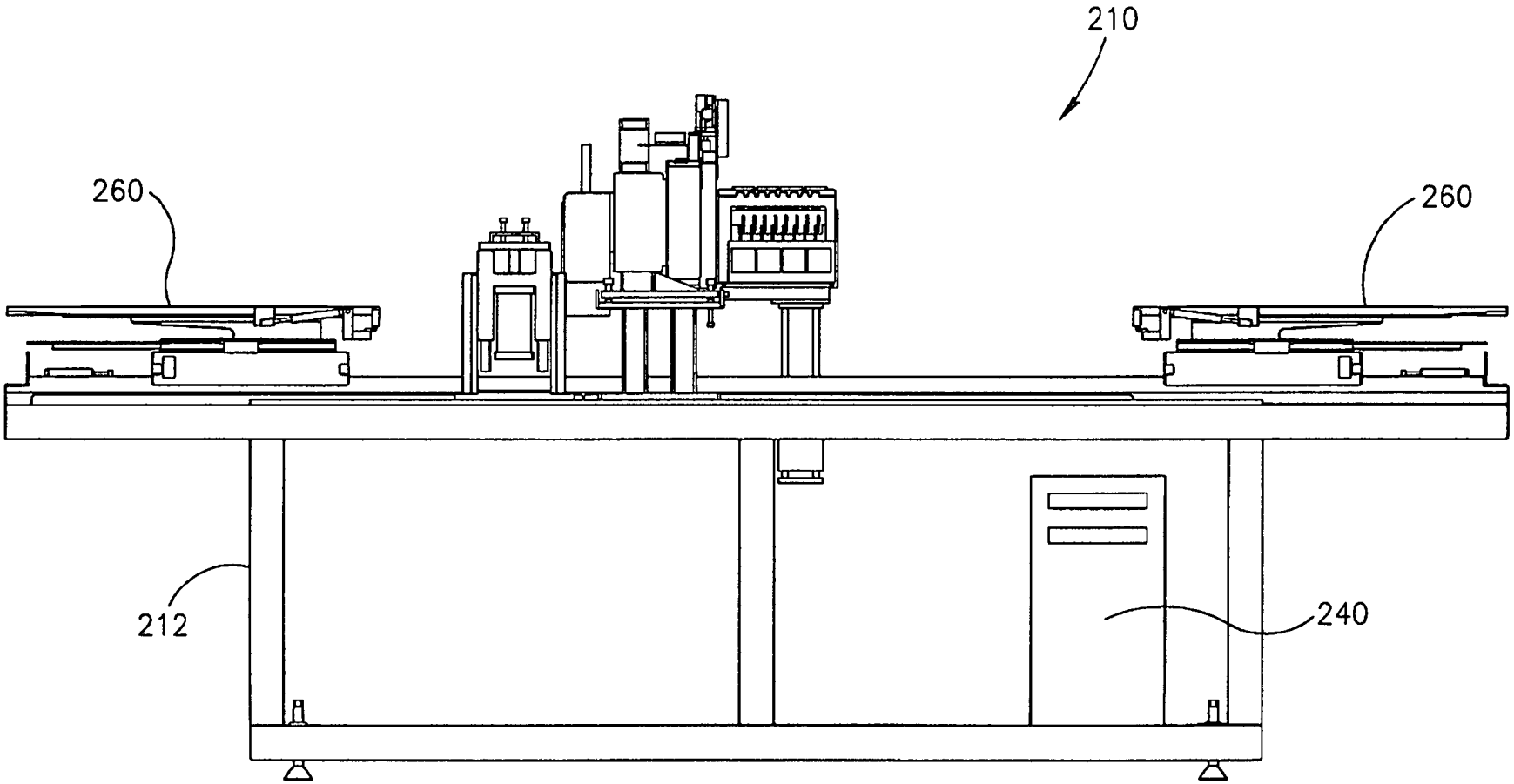
FIG. 8 is a side view drawing of a garment printing machine constructed and operative in accordance with third embodiment of the present invention.

Referring now to FIG. 8, a side view of a printing machine 210 according to a third embodiment is presented. Frame 212 is the same as frame 12 shown in FIG. 1. Machine 210 has two independently movable printing table assemblies 260 moving on the base of the same X axis stage. As in a railway with two trains running on the same track, printing table assemblies 260 move back and forth along a single base or track, independently of one another. Printing is performed on one table while at the same time garments are unloaded and loaded on the second table. Each table is accessed from the opposite edge of the machine, and is loaded and unloaded by a different operator. Main computer 240 controls both printing tables.

It will be appreciated that the invention is not limited to what has been described hereinabove merely by way of example. Rather, the invention is limited solely by the claims that follow.

The invention claimed is:

1. A digital printing machine for printing on textile media, comprising:

a rigid frame;

a first linear motion X axis stage mounted on said frame for X axis motion;

a second linear motion X axis stage mounted on said frame alongside said first X axis stage for X axis motion parallel to X axis motion of said first axis stage, and arranged for operation independently of said first axis stage;

a printing table assembly configured for moving back and forth on each said linear X axis stage and for carrying said textile media; and a linear motion Y axis stage mounted on said frame perpendicular to said first and second linear motion X axis stages, above said printing table assemblies; and an array of inkjet nozzles for applying ink on said textile media loaded on said printing table assemblies, said array of inkjet nozzles being mounted on said linear Y axis stage for linear motion perpendicular to said X axis stages;

wherein during said applying said printing, said table assembly passes by said array of inkjet nozzles in said back and forth movements and said array of inkjet nozzles is substantially static on said linear Y axis and wherein said array of inkjet nozzles is configured to move from applying ink on a first of said printing table assemblies to applying ink on a second of said printing table assemblies, such that downtime for loading textiles onto one of said printing table assemblies is utilized by said applying ink onto a second of said printing table assemblies.

2. The printing machine of claim 1, wherein each said printing table assembly comprises a media-holding plate and an openable cover pivotally coupled to said media-holding plate for holding said media firmly against said plate.

3. The printing machine according to claim 2, wherein said media-holding plate includes a raised portion, and said cover includes a window of the same shape and slightly larger than said raised portion.

4. The printing machine according to claim 1, wherein said linear motion X axis stage is a linear motor driven stage.

5. The printing machine according to claim 1, wherein said linear motion Y axis stage is a linear motor driven stage.

6. The printing machine according to claim 1, where at least part of each said printing table assembly is a vacuum table.

7. The printing machine according to claim 1, wherein said inkjet nozzles include drop-on-demand piezoelectric inkjet nozzles.

8. The printing machine according to claim 1, wherein said inkjet nozzles include continuous piezoelectric inkjet nozzles.

9. The printing machine according to claim 1, further comprising a curing unit located above each said printing table assembly and arranged to cure ink on media on said printing table assembly.

10. The printing machine according to claim 9, wherein said curing unit is an infrared system.

11. The printing machine according to claim 9, wherein said curing unit is a hot air blowing unit.

12. The printing machine according to claim 1, further comprising an ironing unit located above each said printing table assembly and arranged to iron media on said printing table assembly.

13. The printing machine according to claim 1, wherein said back and forth movement comprises a circular movement.

14. A printing machine for printing on textiles comprising:

a rigid frame;

a first linear motion X axis stage mounted on said frame;

a second linear X axis stage mounted on said frame alongside said first linear axis stage for parallel and independent side by side X axis motion;

a printing table assembly configured to move back and forth on said linear X axis stage;

a linear motion Y axis stage mounted on said flame perpendicular to said linear X axis stages, above said printing table assembly;

an array of inkjet nozzles for applying ink on a textile media loaded on said printing table assembly, said array of inkjet nozzles being mounted on said linear Y axis stage for linear motion perpendicular to said X axis stages;

a curing unit located above said printing table assembly and arranged to cure ink on said textile media on said printing assembly;

and an ironing unit located above said printing table assembly and arranged to iron said textile media on said priming assembly before printing thereon;

wherein during said applying said printing table assembly passes by said array of inkjet nozzles in said back and forth movements and said array of inkjet nozzles is substantially static on said linear Y axis and wherein said array of inkjet nozzles is configured to move from applying ink on a first of said printing table assemblies to applying ink on a second of said printing table assemblies, such that downtime for loading textiles onto one of said printing table assemblies is utilized by said applying ink onto a second of said printing table assemblies.

15. The printing machine according to claim 14, wherein said curing unit is an infrared system.

16. The printing machine according to claim 14, wherein said curing unit is a hot air blowing unit.

17. The printing machine according to claim 14, wherein said printing table assembly comprises a media-holding plate and an openable cover pivotally coupled to said media-holding plate for holding said media firmly against said plate.

18. The printing machine according to claim 17, wherein said media-holding plate includes a raised portion, and said cover includes a window of the same shape and slightly larger than said raised portion.

19. The printing machine according to claim 14, where at least part of said printing table assembly is a vacuum table.

20. The printing machine according to claim 14, wherein said printing table assembly is a flattened plate.

21. The printing machine according to claim 14, wherein said inkjet nozzles include drop-on-demand piezoelectric inkjet nozzles.

22. The printing machine according to claim 14, wherein said inkjet nozzles include continuous piezoelectric inkjet nozzles.

23. A printing machine for printing on textiles, comprising:

a rigid frame;

a linear motion X axis stage base mounted on said frame;

a first printing table assembly configured to move back and forth on said linear X axis stage base;

a second printing table assembly configured to move back and forth on said linear X axis stage base alongside said first printing table assembly and independently of said first printing table assembly;

a linear motion Y axis stage mounted on said frame perpendicular to said linear X axis stages, above said printing table assemblies; and an array of inkjet nozzles for applying ink on a textile media loaded on said printing table assembly, said array of inkjet nozzles being mounted on said linear Y axis stage for linear motion perpendicular to said X axis stage;

wherein during said applying said printing table assembly passes by said array of inkjet nozzles in said back and forth movements and said array of inkjet nozzles is substantially static on said linear Y axis and wherein said array of inkjet nozzles is configured to move from applying ink on a first of said printing table assemblies to applying ink on a second of said printing table assemblies, such that downtime for loading textiles onto one of said printing table assemblies is utilized by said applying ink onto a second of said printing table assemblies.

24. The printing machine of claim 23, further comprising an ironing unit located above said printing table assemblies and arranged to iron media on said printing table assemblies.

25. The printing machine according to claim 23, further comprising a curing unit located above said printing table assemblies and arranged to cure ink on media on said printing table assemblies.

26. The printing machine according to claim 25, wherein said curing unit is an infrared system.

27. The printing machine according to claim 25, wherein said curing unit is a hot air blower.

28. The printing machine of claim 23, wherein said printing table assembly comprises a media-holding plate and an openable cover pivotally coupled to said media-holding plate for holding said media firmly against said plate.

29. The printing machine of claim 28, wherein said media-holding plate includes a raised portion, and said cover includes a window of the same shape and slightly larger than said raised portion.

30. The printing machine according to claim 23, where at least part of each printing table assembly is a vacuum table.

31. The printing machine according to claim 23, wherein said inkjet nozzles include drop-on-demand piezoelectric inkjet nozzles.

32. The printing machine according to claim 23, wherein said inkjet nozzles include continuous piezoelectric inkjet nozzles.

* * * * *